United States Patent [19]

Stevenson

[11] Patent Number: 4,802,265

[45] Date of Patent: Feb. 7, 1989

[54] REMOVABLE SKIRT AND TROUSER CLIP FOR GARMENT HANGER

[76] Inventor: Robert L. Stevenson, 7320 W. 87th St., Overland Park, Kans. 66212

[21] Appl. No.: 103,803

[22] Filed: Oct. 1, 1987

[51] Int. Cl.[4] ..... A41D 27/22; A47G 25/48

[52] U.S. Cl. ..... 24/335; 24/525; 24/532; 211/119.13; 211/124; 223/91; D6/326; D6/328; D32/64

[58] Field of Search ..... 223/90, 91, 93, 96; 24/457, 500, 501, 508, 509, 510, 483, 529, 335, 532, 555, 525, 557, 565, 567; 211/119.13, 124; D6/326, 328; D32/61, 62, 64

[56] References Cited

U.S. PATENT DOCUMENTS

| | | | |
|---|---|---|---|
| 385,650 | 7/1888 | Wemple | 24/510 X |
| 501,392 | 7/1893 | Wiedenmann | 24/457 X |
| 847,106 | 3/1907 | Pasqualin | 211/119.13 X |
| 884,680 | 4/1908 | Polakoskey | 211/119.13 X |
| 2,376,584 | 5/1945 | Dessureau | 223/91 |
| 2,506,783 | 5/1950 | Fauteux, Jr. | 24/532 |
| 2,535,640 | 12/1950 | Levine | 211/119.13 |
| 2,723,786 | 11/1955 | Martin . | |
| 2,804,711 | 9/1957 | Kozar | 24/508 X |
| 2,811,292 | 10/1957 | Neudecker et al. . | |
| 2,842,823 | 7/1958 | Kopelman | 24/457 |
| 3,054,539 | 9/1962 | Deutsch et al. . | |
| 3,405,429 | 10/1968 | Vazquez | 223/96 X |
| 3,418,698 | 12/1968 | Holcomb | 223/96 X |
| 4,335,838 | 6/1982 | Bisk et al. . | |
| 4,382,531 | 5/1983 | Bisk et al. . | |
| 4,660,750 | 4/1987 | Blanchard . | |

FOREIGN PATENT DOCUMENTS

| | | | |
|---|---|---|---|
| 804100 | 4/1951 | Fed. Rep. of Germany | 24/501 |

*Primary Examiner*—Robert R. Mackey
*Attorney, Agent, or Firm*—Wm. Bruce Day

[57] ABSTRACT

A removable skirt and trouser clip for garment hangers includes a pair of rigid, elongated fingers connected in a pinching relationship by a spring, and jaws located at one end of each of the fingers are urged together by the spring for holding garments therebetween. A connector adjacent another end of one of the fingers attaches the fingers below the horizontal crossbar of a garment hanger. The connector includes a pair of opposed members with a plurality of recesses located on the mating faces of each of the opposed members for receiving and clamping about the crossbar.

1 Claim, 1 Drawing Sheet

REMOVABLE SKIRT AND TROUSER CLIP FOR GARMENT HANGER

FIELD OF THE INVENTION

This invention relates to garment hangers, and in particular to clips for use thereon, as well as for other uses.

BACKGROUND OF THE INVENTION

There are numerous garment hangers commercially available today which are well known and have been used for years. Several hangers incorporate clamps into their design. These clamps have been recognized as being deficient in one or more aspects. They often are complicated and difficult to assemble, as well as having limited use. Furthermore, many clamps are not long lasting and are awkward to manipulate.

OBJECTS OF THE INVENTION

It is, therefore, the primary object of the present invention to provide a removable clip for use with standard garment hangers which can suspend skirts, trousers or the like from standard garment hangers, such clips functioning like a clothespin and attaching to the hanger by use of a connector which allows the clip to hang below the crossbar of the hanger for easy manipulation.

It is another object of the present invention to provide a removable clip as aforesaid, which is inexpensive to manufacture.

It is a further object of the present invention to provide a removable clip as aforesaid that is easily adjustable to accommodate various widths and types of garments.

It is still another object of the present invention to provide a removable clip as aforesaid which allows one garment to be suspended below the horizontal crossbar of a garment hanger while a second garment can be folded over the crossbar, as the clip of the present invention does not interfere with the use of the crossbar.

It is still a further object of the present invention to provide a removable clip as aforesaid which can readily be attached to standard garment hangers or to any other rod-like objects in such a way as to overcome the deficiencies in the prior art.

It is a still further object of the present invention to provide a removble clip as aforesaid which can accommodate varying sizes of crossbars.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

As required, a detailed embodiment of the present invention is disclosed herein, however, it is to be understood that the disclosed embodiment is merely exemplary of the invention which may be embodied in various forms. Therefore, specific structural and functional details disclosed herein are not interpreted as limiting, but merely as a basis for the claims and as a representative basis for teaching one skilled in the art to variously employ the present invention in virtually any appropriately detailed structure.

Figure 1:
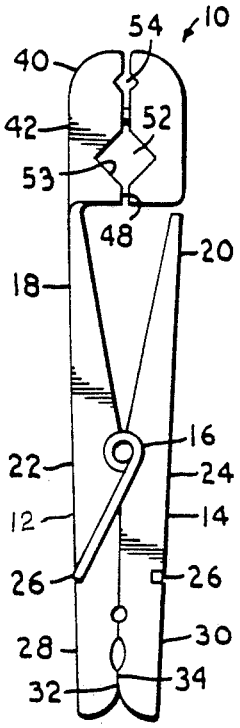
FIG. 1 is a plan view of the removable clip constructed in accordance with one aspect of the invention.

Referring to FIG. 1, a removable clip generally designated 10 is shown for use with standard garment hangers. The clip 10 comprises a pair of rigid, elongated fingers, 12 and 14, with a spring coil 16 for positioning the fingers 12, 14 in a pinching relationship. It is understood that the spring means are not limited to a coil, but can be any other suitable spring means. Each finger 12, 14 has a first end portion, 18 and 20 respectively, which are spaced apart from each other. The spring 16 attaches the fingers 12, 14 at intermediate portions, 22 and 24 respectively. The second end portions, 28 and 30 respectively, of each finger 12, 14 contain jaws, 32 and 34 respectively, wherein the jaws 32, 34 are urged into pinching contact with each other by the spring extension 26 of the spring coil 16. The jaws 32, 34 can be opened to receive a garment and can then be closed to retain the garment within the jaws 32, 34. The jaws 32, 34 are opened by applying pressure to the first end portions 18, 20 of the clip 10 to move them towards each other by overcoming the force of the spring 16. Releasing the first end portions 18, 20 moves the jaws 32, 34 back into pinching contact with each other.

Figure 2:
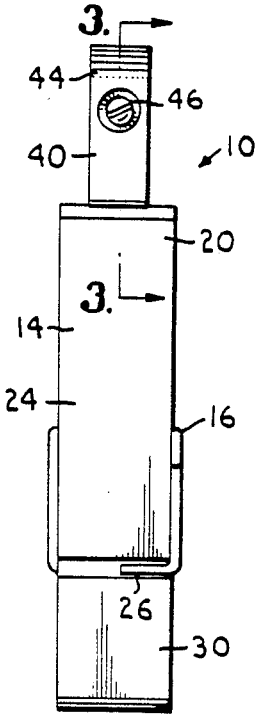
FIG. 2 is a fragmentary horizontal cross section of the connector portion of the removable clip.

A connector generally referred to as 40, is located adjacent the first end portion 18. The connector 40 comprises a pair of opposed members, 42 and 44, detachably secured to each other by fastener means 46. The fastener means 46 can be a nut 60 and screw 58 assembly as shown in FIG. 2, or any other suitable fastener means. Mating faces, 48 and 50 respectively, of the opposed members 42, 44 contain a plurality of corresponding recesses, 52 and 54, which are of various graduated sizes. The recesses 52, 54 receive a portion of the periphery of a crossbar 62 and when the screw 58 and nut 60 are tightly secured, allow the clip 10 to be attached to the crossbar 62 of a garment hanger or any other rod-like object. Providing a plurality of graduated sizes for the recesses 52, 54 allows the clip 10 to accommodate numerous different sizes of crossbars 62.

Figure 3:
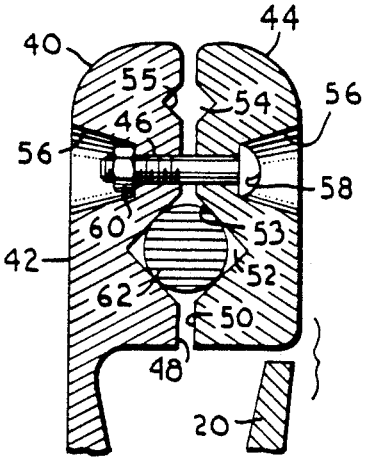
FIG. 3 is a plan view of the removable clip attached to the crossbar of a standard garment hanger.

Referring now to FIG. 3, the connector 40 is shown in more detail. Holes 56 are bored through each opposed member 42, 44 to accommodate a screw 58 and nut 60. The recesses 52, 54 are of triangular shape and form diamond shaped apertures when mated. The diamond shaped aperture extends about the crossbar 62, and the central portion of each wall 53, 55 of the recesses 52,54 secures a portion of the periphery of the crossbar 62 with a frictional grip. The crossbar 62 of a hanger is shown in cross section with a clip 10 attached thereto, tightly secured within the recess 52 by the frictional grip of the recess walls 53 and by tightening the screw 58 and nut 60 assembly. The connector 40 can be moved along the crossbar 62 to any desired position in order to accommodate garments of varying widths by simply loosening the screw 58 until the desired position is achieved, and then tightening the screw 58 again.

Figure 4:
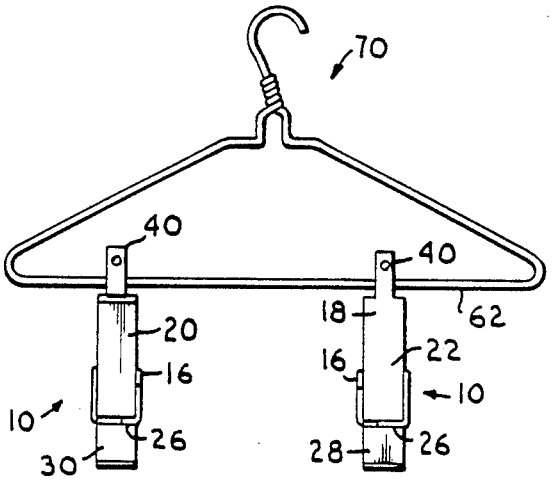
FIG. 4 is a front elevational view of a removable clip mounted on a garment hanger.

Referring now to FIG. 4, the clip 10 is shown as used in conjunction with the standard garment hanger 70. The connector 40 is attached to the crossbar 62 of the hanger 70, and secured by tightening the screw 58 and nut 60. As can be seen, the top edge of the connector 40 projects only a minimal distance above the crossbar 62, thus allowing the hanger to be used by folding garments over the crossbar 62 even when the clips 10 are attached to the hanger 70 and in use. As can further be seen in FIG. 4, the first end portions 18, 20 of the fingers 12, 14 of the clip 10 are positioned below the crossbar 62, allowing the first end portions 18, 20 o be moved together in order to open the jaws 32, 34 without having to awkwardly manipulate the hand around the crossbar 62.

Any inexpensive yet durable material can be used to manufacture the clip 10. Two of the contemplated materials are plastic and wood. It is to be understood, however, that the material used to manufacture the clip is not an inventive feature of the present invention, and any suitable material can be used.

It is to be understood that while certain forms of this invention have been illustrated and described, it is not limited thereto, except insofar as such limitations are included in the following claims.

What is claimed and desired to be secured by Letters Patent is as follows:

1. An attachment for a garment hanger having a horizontal cross bar and comprising:

(a) a single pair of rigid, elongate fingers with a single spring coil mounted medially and positioning said fingers in a pinching relationship;

(b) jaw portions at respective first ends of each of said fingers and urged into pinching contact by said spring coil for retaining an article of clothing therebetween;

(c) said fingers being spaced apart at respective second ends with one of said fingers including an extension portion projecting linearly outwardly;

(d) an opposing block member positioning against said extension portion and separate from the other of said fingers, said block member being detachably connected to said extension portion by a screw and nut assembly;

(e) said extension portion and said block member having opposing faces with a plurality of triangular shaped recesses of correspondingly graduated sizes located at intermediate positions and forming a diamond shaped aperture when said recesses are mated for receiving and clamping about said cross-bar whereby said attachment is securely suspended from said cross bar and maintains a garment in hanging relation to said garment hanger.

* * * * *